United States Patent [19]

Simeth

[11] Patent Number: 4,484,522

[45] Date of Patent: Nov. 27, 1984

[54] SYSTEM FOR REDUCING SETTING-UP TIME IN PRINTING MACHINES HAVING REGISTER ADJUSTMENT DEVICES

[75] Inventor: Claus Simeth, Offenbach am Main, Fed. Rep. of Germany

[73] Assignee: M.A.N. Roland Druckmaschinen AG, Fed. Rep. of Germany

[21] Appl. No.: 472,044

[22] Filed: Mar. 4, 1983

Related U.S. Application Data

[63] Continuation-in-part of Ser. No. 410,564, Aug. 23, 1982, abandoned.

[30] Foreign Application Priority Data

Sep. 16, 1981 [DE] Fed. Rep. of Germany ..... 31367038

[51] Int. Cl.[3] ..... B41F 13/24

[52] U.S. Cl. ..... 101/248; 101/181; 364/300; 364/469; 226/28; 226/30

[58] Field of Search ..... 101/248, 216, 181, DIG. 12, 101/174; 226/3, 29–30, 27–28, 45; 364/300, 559–560, 469; 271/26

[56] References Cited

U.S. PATENT DOCUMENTS

| | | | |
|---|---|---|---|
| 2,802,666 | 8/1957 | Crosfield | 271/26 |
| 3,084,621 | 4/1963 | Guastavino | 101/248 |
| 3,102,471 | 9/1963 | Auer et al. | 226/27 |
| 3,120,181 | 2/1964 | Thiede | 226/29 |
| 3,165,056 | 1/1965 | Heatley, Jr. et al. | 226/30 |
| 3,339,817 | 9/1967 | French | 101/248 |
| 3,520,253 | 7/1970 | Head, Jr. | 101/181 |
| 3,717,092 | 2/1973 | Crum | 101/248 |
| 3,791,294 | 2/1974 | Skelding et al. | 101/248 |
| 3,841,216 | 10/1974 | Huffman | 101/248 |
| 4,025,025 | 5/1977 | Bartel et al. | 101/181 |
| 4,033,259 | 7/1977 | Schuhmann | 101/174 |
| 4,135,664 | 1/1979 | Resh | 226/3 |
| 4,264,957 | 4/1981 | Pautzke | 101/248 |
| 4,318,176 | 3/1982 | Stratton et al. | 101/248 |
| 4,364,502 | 12/1982 | Frentress | 226/3 |
| 4,437,403 | 3/1984 | Greiner | 101/248 |
| 4,742,849 | 7/1973 | Greiner et al. | 101/248 |

FOREIGN PATENT DOCUMENTS

| | | | |
|---|---|---|---|
| 644547 | 7/1962 | Canada | 226/29 |
| 23299 | 2/1981 | European Pat. Off. | 101/248 |
| 2023467 | 11/1971 | Fed. Rep. of Germany | 101/248 |
| 28864 | 3/1981 | Japan | 101/248 |
| 30607 | 3/1981 | Japan | 101/248 |
| 7808954 | 3/1980 | Netherlands | 101/181 |
| 2072097 | 9/1981 | United Kingdom | 101/181 |

OTHER PUBLICATIONS

Heidelberg Offset CPC Brochure, published at Dupra, Jun. 3–6, 1977.

Der Polygraph (MAVO article), 10/22/75, pp. 1393–1400.

Brochure "CCD Analog VLSI-Technology of the 80's" published by Electronic 2000 Vertriebs GmbH Neumarkter Str. 71 presented at the LASER Exposition in Munich on Jun. 2, 1983, pp. 5–6.

*Primary Examiner*—E. H. Eickholt

*Attorney, Agent, or Firm*—Leydig, Voit, Osann, Mayer & Holt, Ltd.

[57] ABSTRACT

An automatic register adjustment system for a multicolor printing machine has a computer for remote control of register adjusting devices and computer drivable optical scanners traversably mounted for axial movement with respect to the cooperating plate cylinders so that the axial and peripheral coordinates of register marks engraved on the printing plates are determinable. Before printing starts, the printing plates are automatically adjusted for precise register with respect to each other. The register marks may be placed at any desired position on the printing plates and the reference coordinates are freely programmable since the optical scanners can approach any desired point on the printing plate. The scanners, for example, are reciprocated in synchronism with plate cylinder rotation at a speed generally proportional to the rotational speed of the printing machine so that the axial and peripheral coordinates of the register marks are simultaneously sensed. An optimization procedure is also disclosed for minimizing the required adjustment device time and detecting whether the register error exceeds the maximum adjustment travel.

20 Claims, 15 Drawing Figures

SYSTEM FOR REDUCING SETTING-UP TIME IN PRINTING MACHINES HAVING REGISTER ADJUSTMENT DEVICES

This application is a continuation-in-part of application Ser. No. 410,564, filed Aug. 23, 1982 and now abandoned.

This invention relates generally to an automatic control method and apparatus for adjusting printing plates mounted on plate cylinders, aligned in register with one another for the combined printing operation.

In multi-color printing machines, and particularly rotary presses, in which the printed sheet is printed in a plurality of colors in one pass through the machine, perfect printing requires that the printing plates roll on the sheets with exact register. In order to eliminate any differences due to the fitting of the plates on the cylinders, the individual cylinders are slidable axially and peripherally. This setting up of the cylinder adjustment is known as axial or side and circumferential or peripheral register adjustment. There is also a diagonal or skew adjustment required for exact register. This adjustment work for multi-color printing machines is very time-consuming and demanding on the press operator. Since in practice accurate adjustment of register was hitherto possible only by printing or running a number of proofs or test sheets, the considerable loss of time was also accompanied by a varying quantity of spoils. The press operator determines the amount of register adjustment for the plate cylinders of the various colors, for example, by visual inspection of alignment marks of the respective colors printed on the proofs.

It should be noted that once the proofs have been run, there are available automatic register adjusting means that are in practice controlled from a central control console to adjust the plate register by amounts specified by the press operator.

To reduce printing machine preparation time, various means and aids have been disclosed for initially adjusting the printing plates on the plate cylinders, although they do not reliably guarantee 100% register of the printing plates since only the positions of the printing plates relative to the associated cylinders are checked, and not the positions of the printing plates on the cylinders relative to one another. German Utility Model No. 7 245 711 discloses providing a plate cylinder with mountings at accurately defined points, said mountings having receiving bores adapted to receive a support with a reticle magnifier. With this device it is possible to bring the printing plate exactly into a predetermined position relative to the cylinder. But it is not possible to adjust the printing plates in register with each other since there is no relationship between the individual cylinders. Another optical magnifying device for measuring the alignment of a printing plate with respect to its associated plate cylinder is disclosed in U.S. Pat. No. 4,033,259. With this device, peripheral reference marks at the ends of the plate cylinder can be viewed simultaneously with respective index marks on the printing plates.

The principal object of the invention is to provide a system which, before printing starts, enables the printing plates clamped on the plate cylinders to be aligned automatically in exact register with one another.

Another object of the invention is to check, before the first print, whether the printing plates are clamped so as to be aligned as close as possible to exact register prior to the start of printing.

Still another object of the invention is to eliminate the time-consuming adjustment of the printing plates relatively to one another.

A further object of the invention is to provide an automatic register adjustment system wherein the register marks may be placed at any desired position on the printing plates, without requiring a corresponding mechanical adjustment to the automatic register adjustment system.

Briefly, in accordance with the invention, known automatic means for adjusting the plate cylinders in response to register control signals are controlled by an automatic control system which measures the positions of the individual printing plates and compares the measured positions to a corresponding set of reference positions to generate the register control signals. The reference positions are preselected so that the control system tends to bring the printing plates in register with one another for the combined printing operation. The sensing of plate positions is performed by optical scanners mounted to the press frame adjacent to the printing plates and which sense register marks copied on the printing plates in exact register. The optical scanners for each respective plate cylinder are disposed to be traversable along an axial cross-member and drivable under numerical control to precise predetermined coordinates. By correlating the signals from the optical scanners with the predetermined coordinates to which the scanners are driven, the axial coordinates of the reference marks on the respective printing plate are obtained. Similarly, the peripheral or circumferential coordinates are determined by correlating the signals from the scanners with the phase or speed of the respective plate cylinder or machine drive. In a preferred embodiment, the optical scanners are drivable under computer control to any desired axial coordinates and are enabled to sense the register marks during a programmed range or "window" of plate cylinder phase angle, so that the precise locations of the register marks may be determined regardless of where the marks are engraved on the printing plates and without requiring a manual setup of the scanners for alignment with the general locations of the register marks.

To reduce register adjustment time, the preferred embodiment selects a setpoint, for each individual register adjustment operation, according to an optimization procedure, and the control system indicates to the operator if the adjustment required for register exceeds the maximum adjustment travel of the means for adjusting the plate cylinders. Preferably the register marks are in the form of asymmetrical right-angle crosses, with one limb for side register extended over a zone of the cylinder periphery, and another limb extended axially. Preferably the scanners sweep axially in synchronism with the rotation of the plate cylinders and the axial speed of travel of the scanners is generally proportional to the rotational speed of the printing machine. So that the press operator may comprehend the available range and current status of the register adjustment, the peripheral, axial and diagonal register deviations of the printing plates are displayed separately.

Other objects and advantages of the invention will become apparent upon reading the following detailed description and upon reference to the drawings in which.

Figure 1:
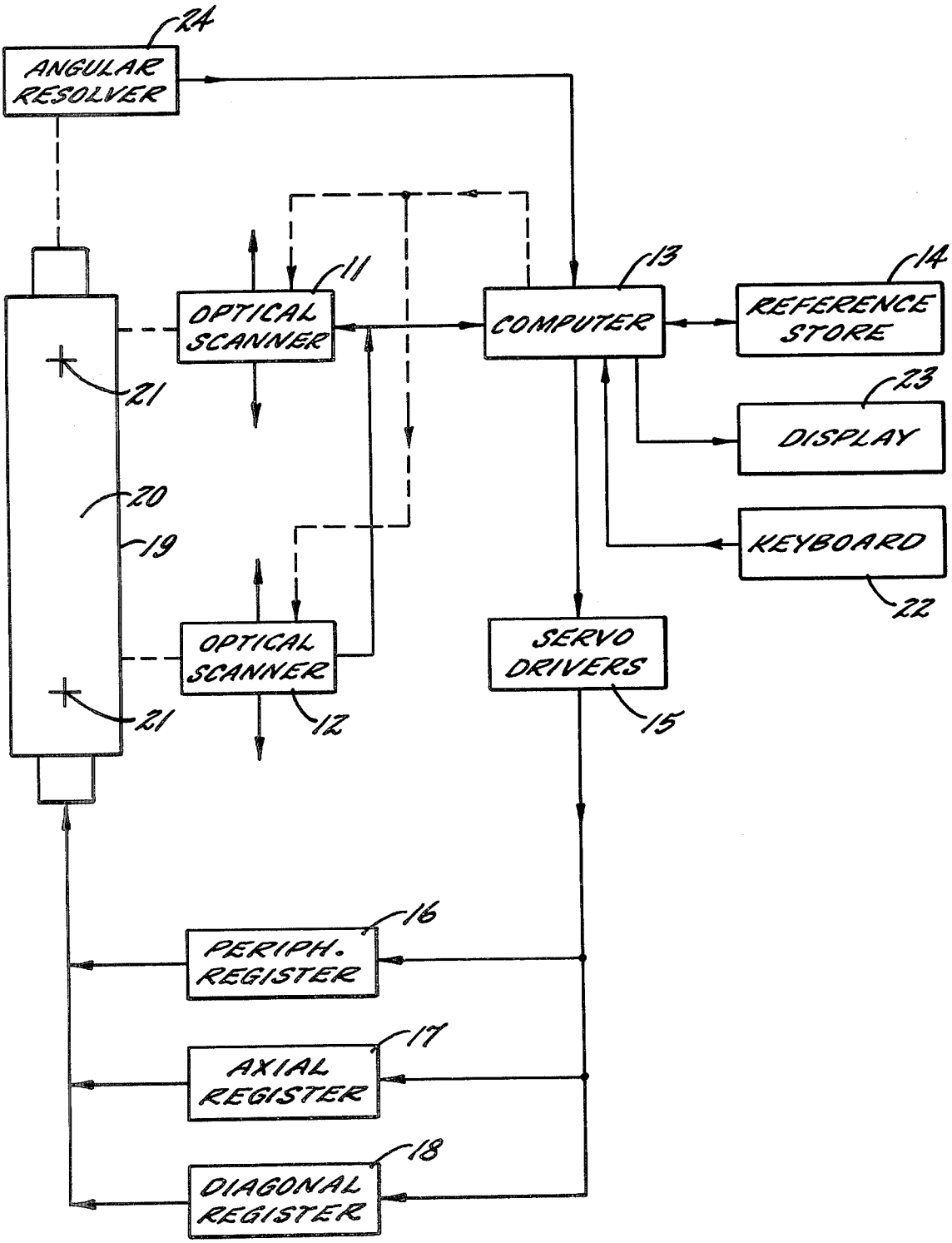
FIG. 1 is a block diagram of one embodiment of the invention for automatic register control of a printing press, only one of the plate cylinders being shown.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Turning now to the drawings, there is shown in FIG. 1 a block diagram of a register adjustment system according to the invention. The system comprises optical scanners 11 and 12, a computer 13, a reference value store 14, servo drivers or amplifiers 15, and register adjustment devices for peripheral or circumferential register 16, axial or side register 17, and diagonal or skew register 18. The register adjustment devices position the printing plate 20 with respect to the machine frame by adjusting the position of the plate cylinder 19 with respect to the machine frame.

For each plate cylinder in a multicolor printing machine, the optical scanners 11, 12 scan the position of the register marks 21 engraved on the printing plate 19 and the scanner output signals are delivered to the computer 13. The computer 13 compares the measured position values derived from the optical scanner 11, 12 signals with predetermined reference values contained in a reference store 14 and representing the desired coordinates of the register marks 21 on the printing plate 20. The predetermined coordinates of the register marks 21, for example, are entered by the machine operator from a keyboard 22 to the computer 13 and transferred to the reference store 14. Thus, the register adjustment system can adjust the plate register by sensing register marks 21 which may be placed at generally arbitrary locations on the printing plate 19. In the event that the computer 13 detects a difference between the sensed positions and the reference values, a control command is transmitted to the corresponding register control system 16, 17 or 18 through the servo drivers or amplifiers 15. The register errors are also communicated to the operator on a display 23. Error conditions, such as the failure of the scanners 11, 12 to sense the register marks 21 or the inability of the register adjustment devices 16, 17, 18 to adjust the register, are also communicated to the operator via by the display 23.

Figure 2:
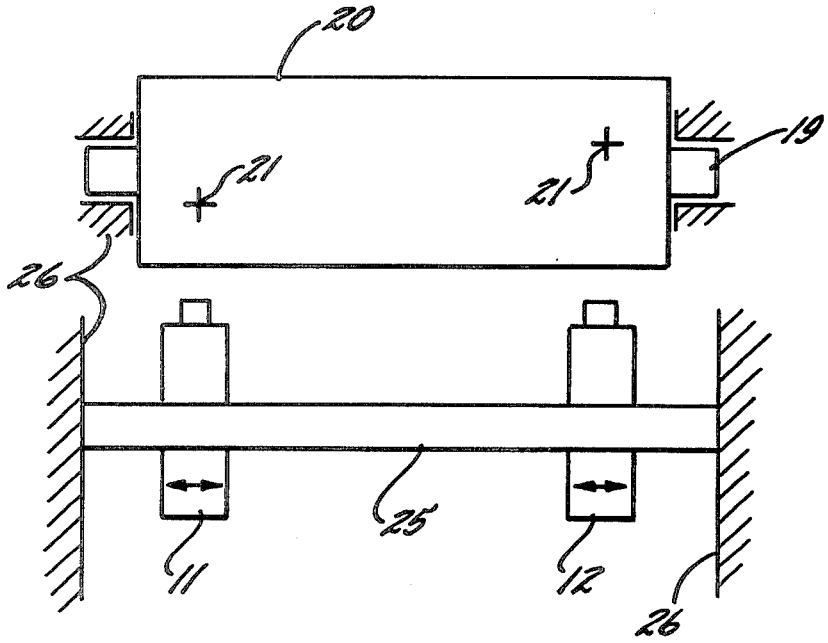
FIG. 2 is a schematic diagram of the arrangement of the optical scanners with respect to the machine frame and one of the plate cylinders.

It should be noted that the axial coordinates of the register marks 21 are determined by correlating the signals from the scanners 11, 12 with the axial positions of the scanners 11, 12, while the peripheral or circumferential coordinates of the register marks 21 are determined by correlating the signal from the optical scanners 11, 12 with the angle or phase of the respective plate cylinder as generally indicated to the computer 13 by an angular resolver 24. As further shown in FIG. 2, a cross-member or linear slide 25 mounted to the machine frame 26 is provided to position the optical scanners 11, 12 at a defined distance from the plate cylinder 19. The scanners 11, 12, for example, are located on top of the plate cylinder and contact between the plate cylinder and the impression cylinder (not shown) occurs at the bottom of the plate cylinder. The optical scanners are disposed on the cross-member 25 to be traversable by means of a motor drive controlled by the computer 13.

According to an important aspect of the invention, the general procedure for a register measurement requires the coordination or synchronization of the scanners 11, 12 with the rotation of the plate cylinder 20 as sensed by the angular resolver 24. At the very beginning of the register adjustment procedure, the machine operator inputs via the keyboard 22 the desired coordinates of the register marks 21 on the printing plate 20. The desired coordinates are transferred by the computer 13 to the reference store 14. The computer 13 also drives the optical scanners 11, 12 along the cross-member 25 to the general axial coordinates of the register marks 21. The times at which the optical scanners 11, 12 are operative is determined by the computer 13 together with the coordinates of the register marks 21 in dependence on the machine phase or speed as indicated by the angular resolver 24.

The optical scanners 11, 12 can remain stationary for a register adjustment in the peripheral direction. As the register marks 11 are traversed, they generate a pulse within a predetermined gating time, and the time of the pulse is compared in the computer 3 with the corresponding values from the reference store 14. If a deviation is detected, the computer 13 delivers via the servo drives or amplifiers 15 an appropriate control command to the peripheral or circumferential register adjustment device 16, which brings the plate cylinder 19 into a new position or angular phase with respect to the machine drive.

Since the register mark for the side register extends in the peripheral direction of the cylinder, the scanning system for checking the side register has a component of velocity in the axial direction with respect to the cylinder in order to generate a pulse by means of the side register portion of the mark 21 during the gating time. Thus, the side register adjustment can use signal processing and input circuits similar to those that are used for determining the peripheral register adjustment.

If the peripheral register adjustment shows a difference between the register mark 21 scanned by the optical scanner 11 and the register mark 21 scanned by the optical scanner 12, in relation to the values in the reference store 14, there is a diagonal or skew deviation. This diagonal deviation can be corrected by the diagonal register adjustment device 18.

Figure 3:
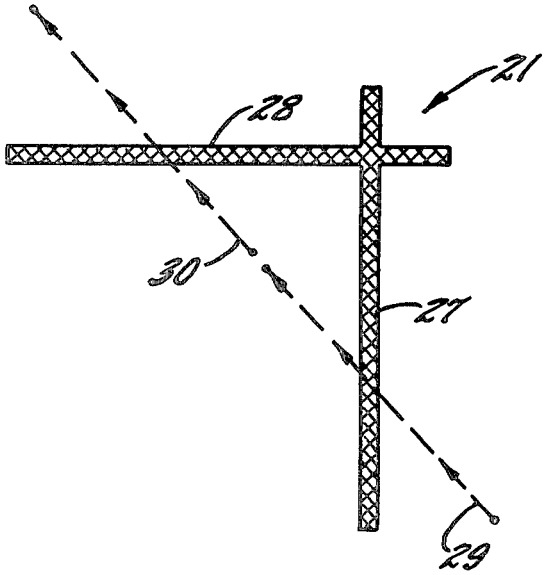
FIG. 3 is a diagram of the preferred form for the register marks and also shows a preferred scanning path to determine the position of the register mark.

As shown in FIG. 3, the register marks 21 are designed on the principle that a limb 27 of maximum possible length should be available for the axial register measurement. This limb extends over a relatively considerable zone of the plate cylinder periphery, so that the speed of travel of the optical scanners 11, 12 for the axial register measurement need not be made too great. Both the peripheral and axial register measurements can be performed simultaneously if the axially extending limb 28 for determining the peripheral register error is also extended as shown in FIG. 3. Then each optical scanner 11, 12, for example, may be comprised of two offset photosensors, one photosensor for scanning the peripheral limb 27 and a second photosensor for scanning the axial limb 28, along diagonal paths 29 and 30, respectively.

If the register deviation between the predetermined value in the reference store 14 and the measured value is greater than the adjustment travel of the respective register adjustment device 16, 17 or 18, this error condition is indicated by a suitable signal such as a message on the display 23. In that case no control command is delivered to the respective register adjustment device by the computer 13. The printing machine operator, for example, should then read the display 23 to determine the kind of deviation involved, for example whether circumferential, axial or diagonal, so that the printing plate 20 may be manually repositioned with respect to the plate cylinder 19.

It should be noted that the computer 13 may activate the register adjustment devices 16, 17, and 18 to bring the plate cylinders automatically into a center or zero position of their adjustment ranges before the printing plates are fitted. This will ensure that after the plates have been fitted on the individual cylinders there remain only slight errors for correction between the individual printing plates. In such a case, if all the register marks are offset from the center position by approximately the same amount, the shortest adjustment time for the register adjustment devices can be obtained by determining a similarly offset target or set point. Moreover, even if the register adjustment devices 16, 17, or 18 are not preset to the middle of their adjustment ranges, an optimum target or set point for adjusting the printing plates in register with one another may be determined by a suitable optimization procedure, as will be described in detail below in conjunction with FIG. 15 and the example given in Table I, appended to the specification.

Figure 4:
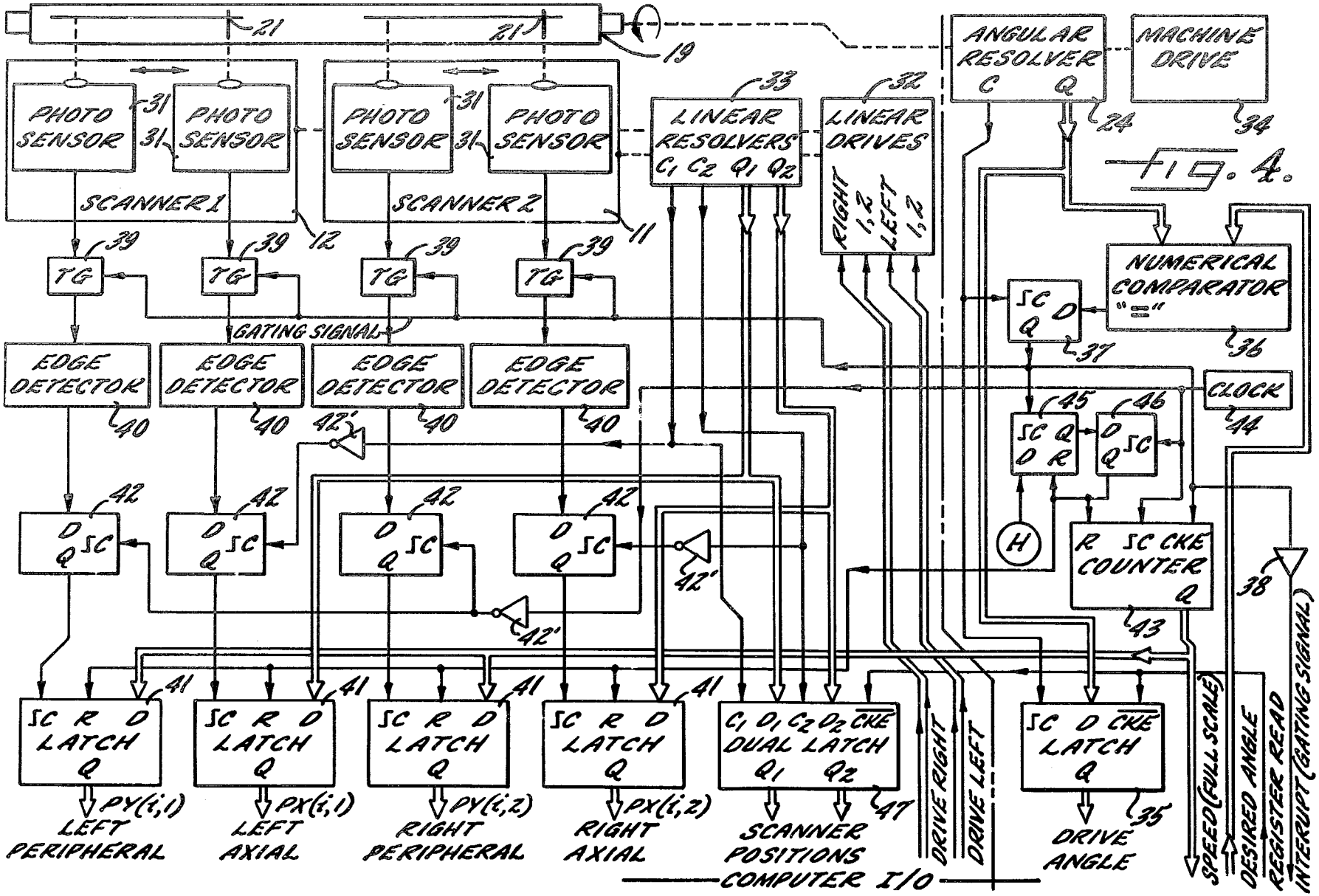
FIG. 4 is a schematic diagram of the interface between the optical scanners and the computer of the automatic register adjustment system.

The interface between the optical scanners 11, 12 and the computer 13 is shown in FIG. 4. Only one plate cylinder 19 is shown in FIG. 4, it being understood that all of the components to the left of the section line are duplicated for the other cooperating plate cylinders in the printing machine. The photosensors 31 are components of the scanners 11, 12. These scanners are driven by linear drives 32 receiving a DRIVE RIGHT and a DRIVE LEFT logic signal from the computer for each of the scanners. The axial position of each of the scanners is sensed by linear resolvers 33 which periodically output multiple-bit binary signals Q1, Q2 denoting the axial position of the scanners 11, 12. In order that stable binary data is transferred from these outputs Q1, Q2, respective clock signals C1, C2 are provided, it being assumed that stable data is clocked out on rising transitions of the clock signals. It should be noted that linear drives and linear resolvers are well known to persons skilled in the art of machine control and they are sold as standard items. The movement and position sensing of the scanners 11, 12 is not unlike the axial movement of a tool holder in a numerically controlled turning lathe. Similarly, the angular resolver 24 sensing the phase of the machine drive 34 is also a standard component of numerically controlled machine tools. The output of the angular resolver 24 is fed to a latch 35 presenting a DRIVE ANGLE output to the computer 13. A clock enable input $\overline{\text{CKE}}$ asserted low is provided on the latch 35 in order that the latch 35 will present stable data during the computer's read cycle.

The output Q of the angular resolver 24 is used for synchronizing the movements of the scanners 11, 12 to the rotation of the plate cylinder 19. For this purpose the computer 13 is interrupted at a particular DESIRED ANGLE of plate cylinder rotation. The DESIRED ANGLE is an output of the computer 13 and is compared to the numeric value of the plate cylinder angle from the angular resolver 24 in order to generate a GATING SIGNAL which is a logical one or "high" over a predetermined angular range starting at the programmed DESIRED ANGLE. The GATING SIGNAL is generated by a numerical comparator 36 which generates a logical high on its "=" output when the DESIRED ANGLE matches the DRIVE ANGLE. A delay flip-flop 37 clocked by the clock C from the angular resolver 24 assures that there are no glitches in the GATING SIGNAL. The numerical comparator 36, for example, is comprised of a bank of exclusive-OR gates which compare the individual binary logic values, the outputs of the exclusive-OR gates asserted low being logically-anded by a NOR gate. The leading and trailing edges of the GATING SIGNAL provide the INTERRUPT to the computer as supplied by a buffer 38.

When the GATING SIGNAL is a logical one, the outputs of the photosensors 31 are fed through transmission gates 39 to edge detectors 40 which look at their input signals from the photosensors 31 to determine when the photosensors 31 are precisely aligned with and focused upon the register marks 21. At these precise instants of time, respective logic transitions are transmitted by the edge detectors 40. Thus the GATING SIGNAL prevents the edge detectors 40 from responding to marks other than the register marks 21 which are presumed to be placed on the plate cylinder 19 at the angular range specified by the DESIRED ANGLE signal outputted by the computer 13. The logic transitions from the edge detectors 40 clock latches 41 which are strobed to receive the instantaneous values of the peripheral or axial coordinates coincident with the logic transitions from the respective edge detectors 40. In order that the latches 41 are not strobed when the position outputs from the linear resolvers 33 or the angular resolver 24 are changing, the outputs of the edge detectors 40 are synchronized by respective delay flip-flops 42. The clock signals to the delay flip-flops are inverted by inverters 42' to compensate for the delay in the flip-flops.

It should be noted that the latches 41 receiving peripheral position data receive their position data not from the angular resolver 24, but from a counter 43 clocked by a high speed clock 44. The counter 43 is reset upon the leading edge of the GATING SIGNAL by a reset pulse generated by a pair of delay flip-flops 45, 46. In this fashion the clock 44 interpolates between the range of the least significant bit of the binary number from the output Q of the angular resolver 24. Thus, the use of a counter 43 clocked by a high speed clock 44 reduces the required precision of the angular resolver 24. The counter 43 also has a clock enabling input CKE asserted high enabled by the GATING SIGNAL, so that after a high-to-low transition of the GATING SIGNAL the counter 43 will hold a full scale or SPEED SIGNAL indicating the rotational speed of the plate cylinder 19. Thus, the values from the counter 43 which are strobed into the peripheral latches 41 may be converted to remainders or linear interpolation fractions by dividing the values latched into the peripheral latches 41 by the full scale SPEED VALUE available on the counter 43 when the counter 43 has stopped counting.

It is evident that the computer 13 should be interrupted upon the leading edge of the INTERRUPT or GATING SIGNAL in order to activate the axial reciprocation of the scanners 11, 12, and the computer 13 should be interrupted on the falling or high-to-low transition of the INTERRUPT or GATING SIGNAL in order to transfer to the computer the data from the latches 41, the DRIVE ANGLE latch 35, and the counter 43. A dual latch 47 is also provided so that the computer 13 may determine at any time the axial positions of the scanners 11, 12. The axial positions of the scanners 11, 12 must be known by the computer 13 in order to initially position the scanners 11, 12 at the general axial locations of the register marks 21.

Figure 5:
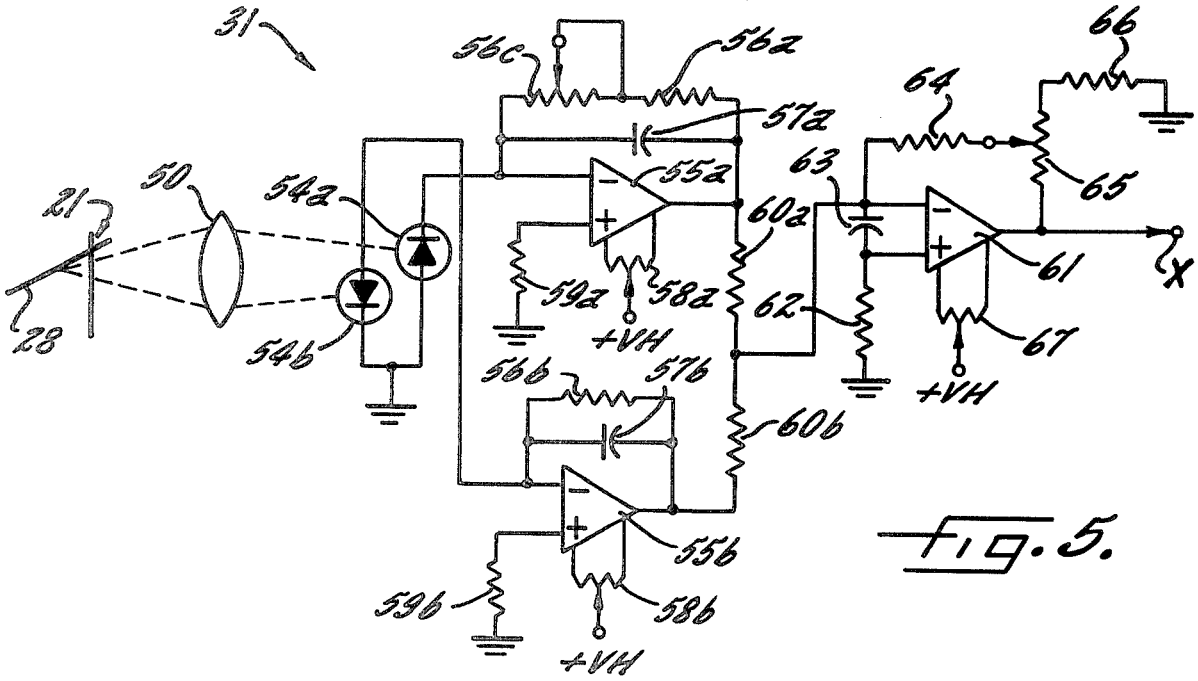
FIG. 5 is a schematic diagram of a preferred embodiment for the photosensors which scan the limbs of the register marks.

The schematic for the photosensor 31 is shown in FIG. 5. In order to generate an electrical signal that is a function of the relative position of the register mark 21 with respect to the photosensor 31, a lens 50 focuses the image of the alignment mark 21 between two photodiodes **54*a*, 54*b* when the photodiodes and lens are precisely aligned with the register mark 21, or shown in FIG. 5 the axial limb 28 for indicating the peripheral register. The two photodiodes 54*a*, 54*b* are differentially connected so that the output signal X is precisely zero when the photosensor 31 is aligned precisely with the register mark 21, irrespective of the level of ambient illumination. But before the differential connection, each photodiode 54*a*, 54*b* has its own respective preamplifier 55*a*, 55*b* so that the signal output level of one of the preamplifiers 55*a* may be adjusted by adjusting its gain so as to match the output level of the other preamplifier 55*b*. The preamplifiers have gain setting feedback resistors 56*a*, 56*b*, band limiting feedback capacitors 57*a*, 57*b*, null adjusting potentiometers 58*a*, 58*b*, and input biasing resistors 59*a*, 59*b*. A rheostat 56*c* is used in conjunction with the first feedback resistor 56*a* to relatively adjust the gain of the first preamplifier 55*a*. Summing resistors 60*a* and 60*b* are used to differentially combine the amplified outputs of the photodiodes 54*a*, 54*b*. A third amplifier 61, having an input bias resistor 62, a filter capacitor 63, a feedback resistor 64, and a gain setting potentiometer 65 and shunt resistor 66**, amplifies the differential signal X to a sufficiently high level.

Figure 6:
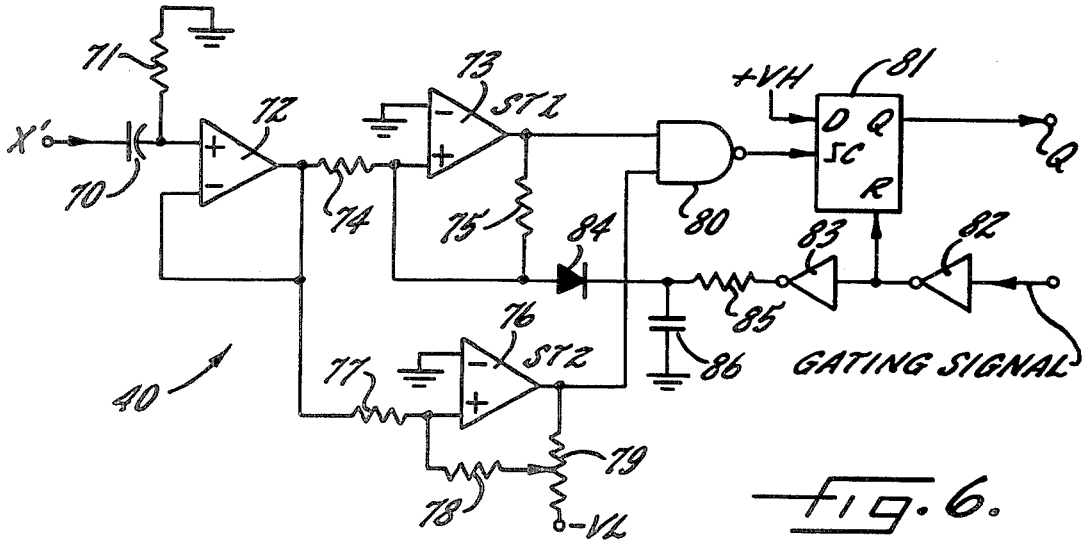
FIG. 6 is a schematic diagram of an edge detector circuit which generates a precise logic transition indicating that the optical sensor of FIG. 5 is precisely aligned over the center of a limb of a corresponding register mark.
Figure 7:
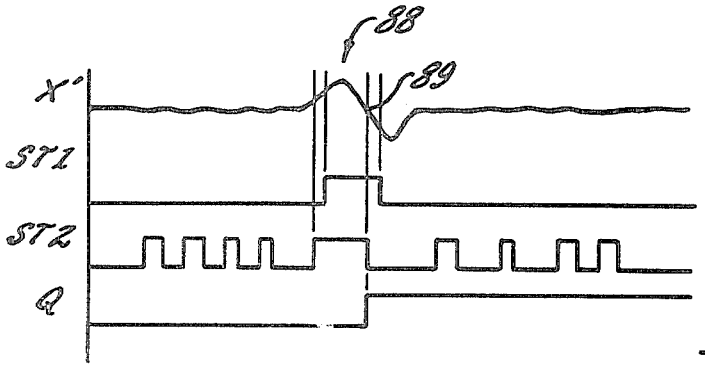
FIG. 7 is a timing diagram illustrating the operation of the edge detector circuit of FIG. 6.

The gated differential signal X' is processed by the edge detector 40 to generate a logic transition signal Q having a leading edge precisely aligned with the point at which the differential signal X has zero output indicating alignment of the photosensor 31 with the alignment mark 21. An embodiment of such an edge detector 40 is shown in FIG. 6 and its operation will be understood by reference to the timing diagram of FIG. 7. A high pass input filter comprising a series capacitor 70, a shunt resistor 71 and a follower 72 strips off any DC bias from the photosensor 31. A first Schmitt trigger comprising an operational amplifier 73, a series resistor 74 and a feedback resistor 75 is set for a high threshold and generates a binary signal ST1 when the gated differential signal X' has a high magnitude indicating the differential pulse 88 coincident with the presence of the reference mark 21. A second Schmitt trigger comprising an operational amplifier 76, a series resistor 77, a feedback resistor 78 and a threshold adjusting resistor 79 has a threshold set at the zero crossing 89 so as to generate a binary output ST2 having a falling edge aligned with the zero crossing 89. From the timing diagram in FIG. 5, it is observed that the desired falling edge of ST2 may be isolated from the other falling edges of ST2 by gating ST2 with the high threshold trigger output ST1. For this purpose, a NAND gate 80 combines the trigger signals ST1 and ST2. The output of the gate 80 is fed to a delay type flip-flop 81 having a logic high $+V_H$ asserted on its D input to thereby function as an edge set flip-flop. The function of the flip-flop 81 is to insure that precisely one transition in the output signal Q will occur after each leading edge of the GATING SIGNAL. The GATING SIGNAL is inverted by an inverter 82 and supplied to the reset input R of the flip-flop 81 in order to set the output signal Q to an initially low state as shown in FIG. 7. To insure that the high threshold Schmitt trigger will be set to an initial low state, a second inverter 83 forward biases a directional diode 84 when the gating signal is logically low. A delay network comprising a resistor 85 and a capacitor 86 keeps the high threshold trigger 73 in its low state sufficiently long enough to reject any transients coincident with the rising edge of the GATING SIGNAL.

Figure 8:
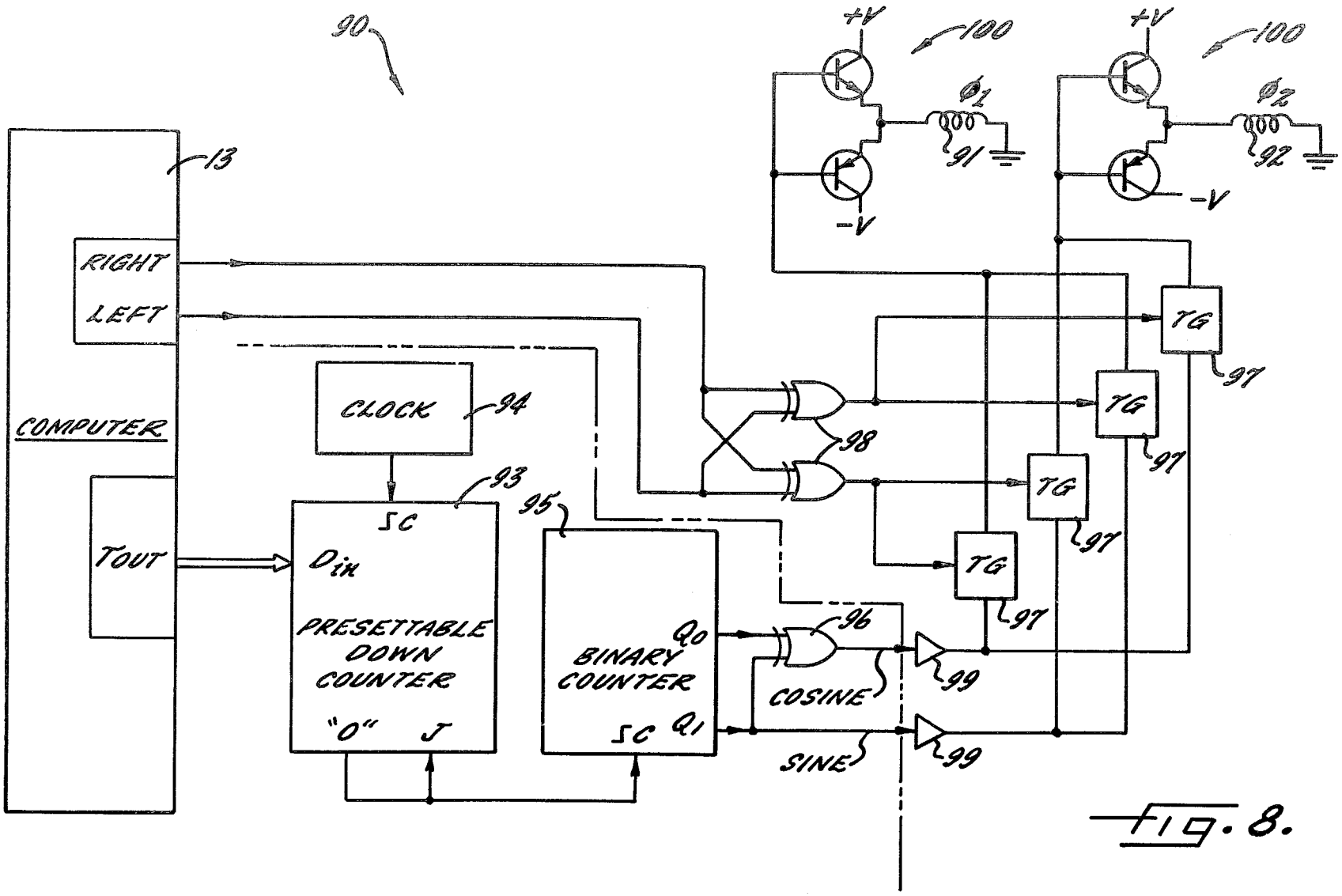
FIG. 8 is a schematic diagram of an exemplary motor interface having means for programming the speed of travel of the optical scanners.

An exemplary interface generally designated 90 between the computer 13 and the two-phase windings 91, 92 of the stepper or synchronous motors in the linear drives 32 is shown in FIG. 8. In order that the speed of axial travel of the scanners 11, 12 may be set generally proportional to the rotational speed of the plate cylinders 19, the computer 13 has a programmable period output $T_{out}$ which specifies the period of the AC exitation signals to the motor windings 91, 92. A presettable down counter 93 accepts a fixed frequency signal from a clock 94. The down counter 93 counts down from the programmed initial count $T_{out}$ and when a zero count is obtained as detected by a logic high on the "0" output, the jam or reset input J is activated, thereby presetting the down counter back to the programmed initial state $T_{out}$. The presettable down counter thus generates a series of pulses having a repetition rate equal to the fixed frequency of the clock 94 divided by the programmed number $T_{out}$ supplied by the computer 13. The sequence of pulses is fed to the clock input of a two stage binary counter 95 in order to generate quadrature signals having 50% duty cycles. A sine signal is obtained from the most significant bit Q1, while an exclusive-OR gate 96 provides a cosine output by combining the two binary outputs Q0 and Q1.

It should be noted that these sine and cosine waveforms are supplied to motor drive circuits associated with each linear drive motor. The circuits for only one motor are shown in FIG. 8, it being understood that the components to the right of the section line are duplicated for each motor. The drive motors run forward or reverse depending on whether the phase applied to one of the motor windings 91 leads or lags the phase applied to the other motor winding 92. In order to select the desired phase relationship, a set of four transmission gates 97 are wired as an electronic double-pole-double-throw (DPDT) reversing switch that is actuated by the RIGHT and LEFT output signals from the computer 13. The DPDT switch is in its center off position when both the RIGHT and LEFT signals are logically low. A pair of cross-coupled exclusive-OR gates 98 prevents the transmission gates 97 from being activated upon the occurrence of the improper condition when both the RIGHT and LEFT signals are simultaneously logically high. The relatively low level signals generated by buffers 99 are amplified to suitably high level signals for driving the motor windings 91, 92 by pushpull Darlington transistors generally designated 100.

Figure 9:
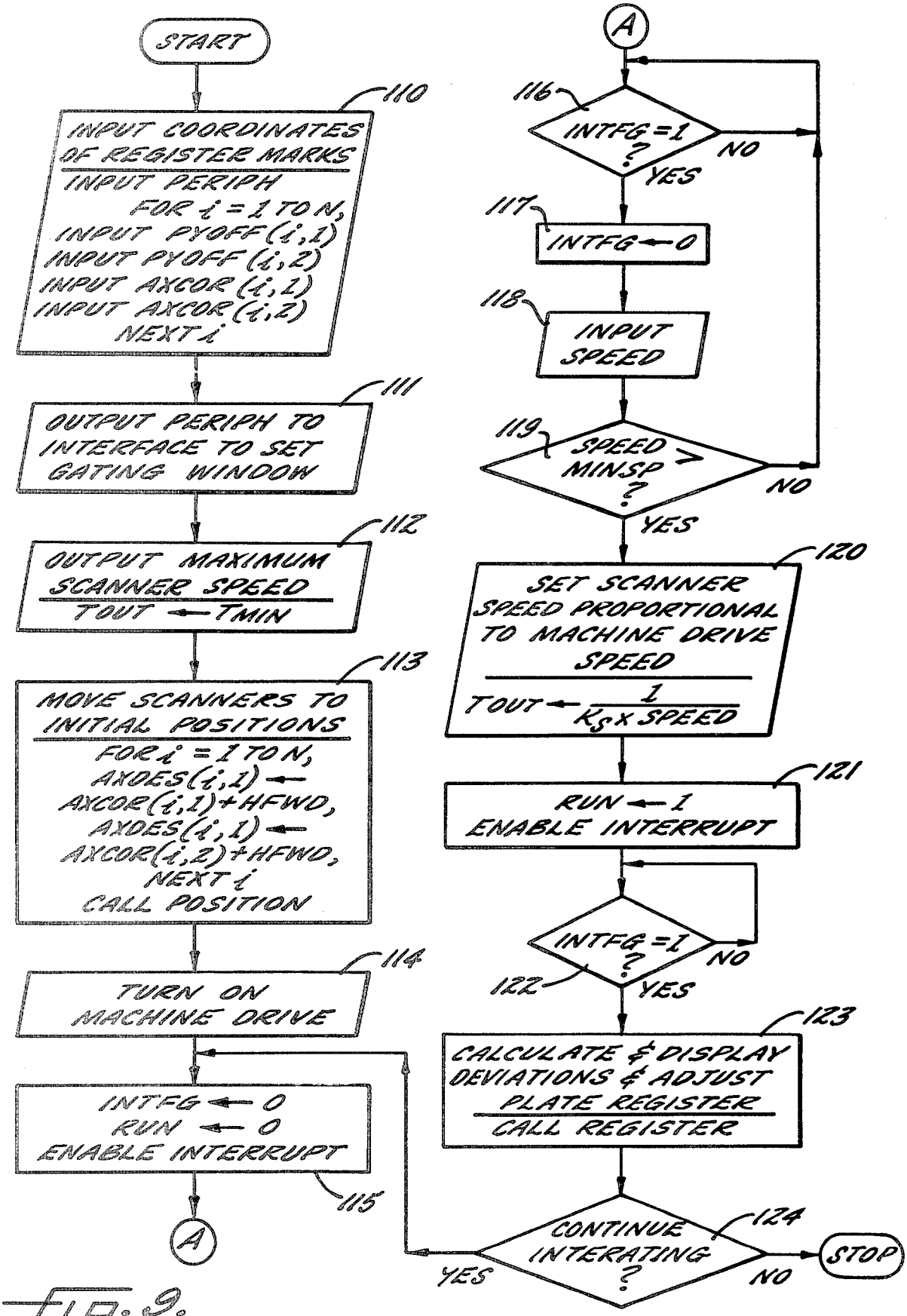
FIG. 9 is a flow chart of an executive program for the register adjustment system according to the invention.

A flow chart of an executive program for the computer 13 in the above-described embodiment of the automatic register control system is shown in FIG. 9. In the initial step 110 the desired or reference coordinates of the register marks are received from the machine operator via the keyboard 22 and stored in the memory or reference store 14. The constant N denotes the number of cooperating plate cylinders in the multi-color printing machine. The constant PERIPH specifies the angle at which the GATING SIGNAL enables the scanners 11, 12 to look at the printing plate 20. The peripheral values PYOFF are offsets or remainder values used to further specify the desired or set point values for the register marks 21 when register is adjusted. It should be noted that even if all of the alignment marks 21 are in exactly the same positions on each of the printing plates 20, the coordinates of the register marks need not be equal, since slight mechanical misadjustments of the optical scanners 11, 12 with respect to the machine frame 26 are more easily corrected by the input of unequal reference coordinates rather than by mechanically adjusting the alignment of the scanners 11, 12 with respect to the machine frame 26. Thus the automatic adjustment system may be occasionally calibrated by first setting the reference coordinates equal for identical printing plates, running several test sheets, and checking the register by the actual inspection of the sheets. Observed register errors in the printed sheets are then most easily compensated for by slightly changing the reference coordinates of the register marks rather than by mechanically adjusting the mounting of the scanners 11, 12.

Figure 10:
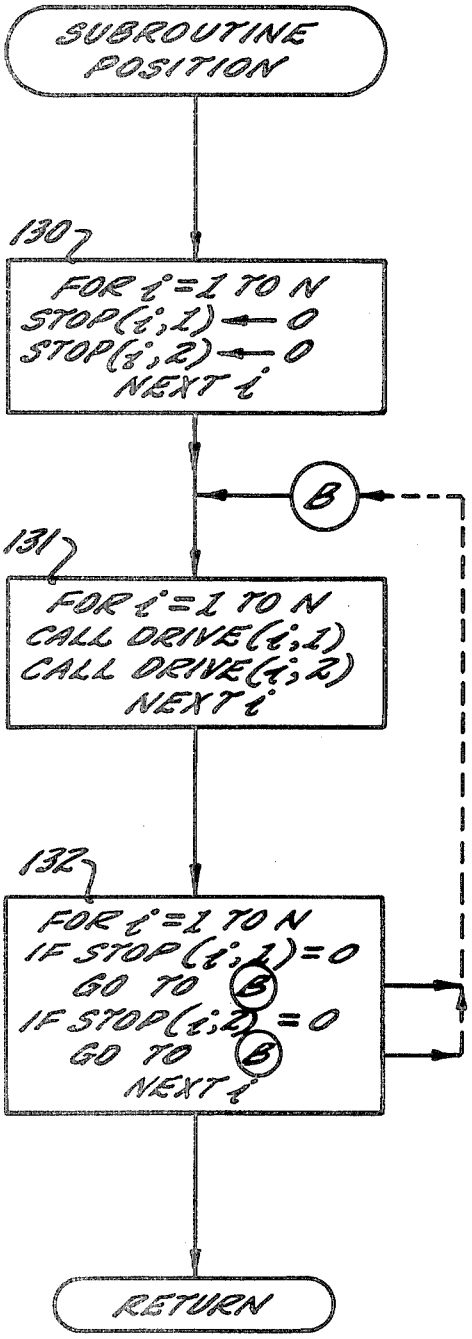
FIG. 10 is a flow chart for a subroutine which drives the optical scanners to predetermined coordinates.

In step 111 the peripheral angle PERIPH is outputted to the interface in FIG. 4 to set the gating window provided by the GATING SIGNAL. In step 112 the maximum scanner speed is set by outputting the minimum permissible period $T_{min}$ to the output port $T_{out}$ in FIG. 8. Then in step 113 the scanners 11, 12 are moved to their initial axial positions. The movement is performed by first calculating desired axial coordinates for each linear drive as the sum of the input axial coordinates and a half width HFWD equal to one-half of the axial width of the register mark 21. Initially, the scanning starts on the right side of the center of the reference mark 21 in order to scan along leftward directed diagonal paths 29, 30 as shown in FIG. 3. After the desired axial coordinates AXDES are calculated, the position determining subroutine of FIG. 10 is called. When execution returns to the executive program, the scanners 11, 12 have been moved to their desired initial positions. Thus in step 114 the machine drive is turned on in order to provide the peripheral movement between the scanners 11, 12 and the alignment marks 21.

Figure 12:
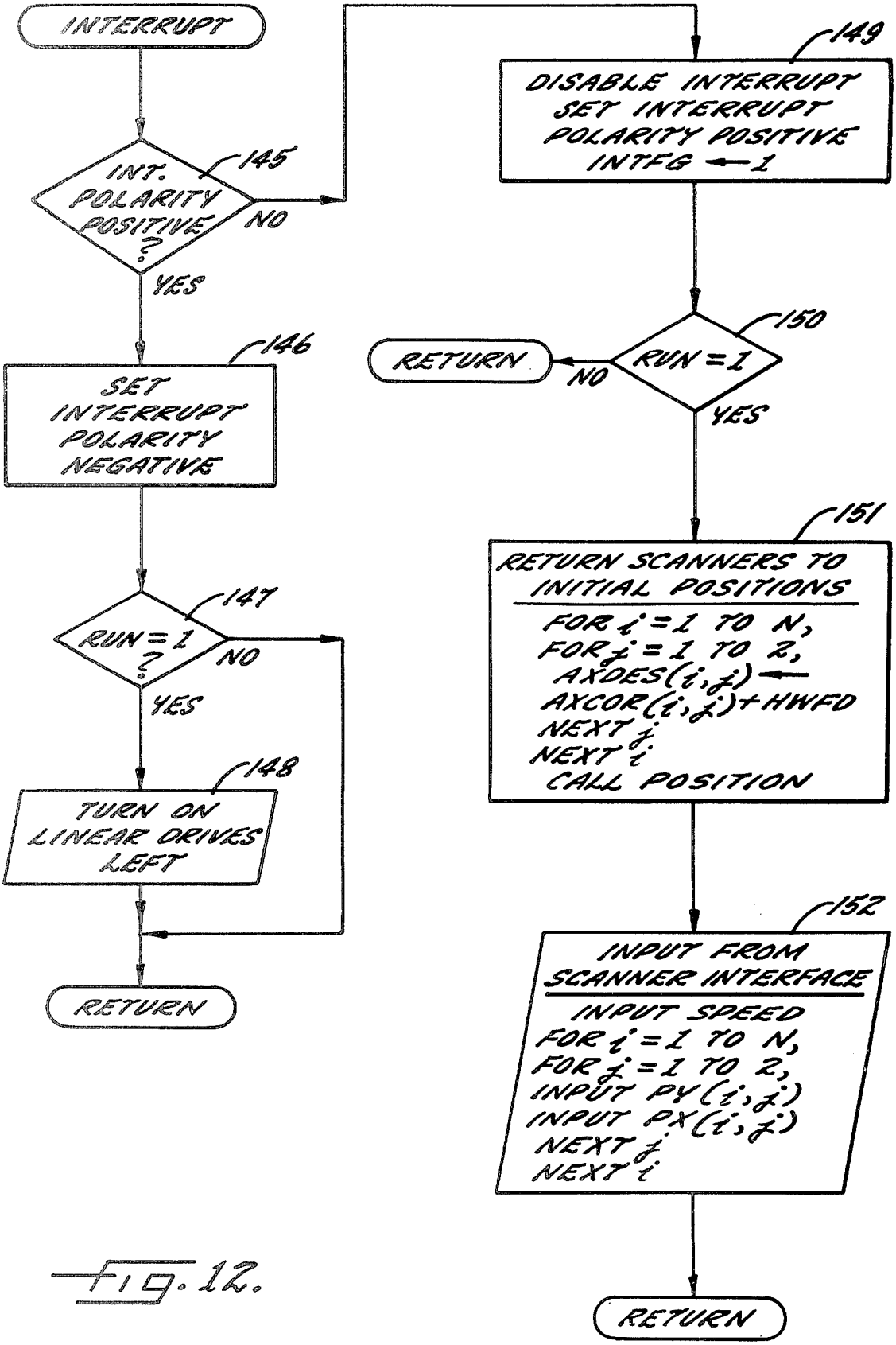
FIG. 12 is a flow chart of an interrupt procedure for synchronizing the reciprocation or sweeping of the scanners with the rotation of the respective plate cylinders in order that the optical scanners sweep across the register marks generally on the scanning path shown in FIG. 3.

In step 115 preparations are performed for enabling the interrupt routine of FIG. 12 to start reciprocating the scanners 11, 12 in the axial direction in synchronism with the rotation of the plate cylinders 19. An interrupt flag INTFG is set to zero in order that the executive program may later detect when the interrupt routine has completed its intended function. The interrupt routine sets the interrupt flag to one after it has performed the operations for one interrupt sequence, corresponding to one rotation of the plate cylinder 19. Also in step 115 a flag RUN is set to zero indicating that the interrupt routine should actually start moving the scanners 11, 12. Finally the interrupt mask in the computer is enabled so that the interrupt routine may start functioning upon the transitions in the INTERRUPT or GATING SIGNAL. It should be noted, then, that execution hand shakes between the executive program of FIG. 9 and the interrupt routine of FIG. 12. In other words, the executive program enables successive interrupts by enabling the interrupt mask bit, while the interrupt procedure enables successive iterations in the executive program by setting the interrupt flag INTFG to one. Thus in step 116 the executive program loops if the interrupt flag is zero, but execution continues if the interrupt flag has been set to one. In step 117 the interrupt flag INTFG is reset to zero. In step 118 the speed of the printing machine is inputted from the counter 43 in FIG. 4 so that it may be compared in step 119 to a minimum speed MINSP. When the minimum speed has been reached, the scanner speed is set in step 120 by calculating the desired period $T_{out}$ as inversely proportional to the speed of the machine.

Now that the plate cylinder 19, is rotating at a sufficiently high speed, the RUN flag is set and the interrupt enabled in step 121 so that the interrupt routine of FIG. 12 will perform the scanning process. After completion of the scanning for one rotation of the plate cylinder 19, the interrupt routine sets the interrupt flag as detected in step 122 of the executive program. Then in step 123 the register deviations and required adjustments are calculated and displayed, and the register adjustment devices are activated, by calling the subroutine REGISTER. Finally, in step 124, the computer determines whether continued iterations are requested or desired. This decision, for example, could be made by the machine operator and sensed by the computer in step 124, or it could be automatic upon achieving sufficiently low register errors. If continued iterations are desired, execution returns to step 115. Otherwise, the executive program is finished.

Figure 11:
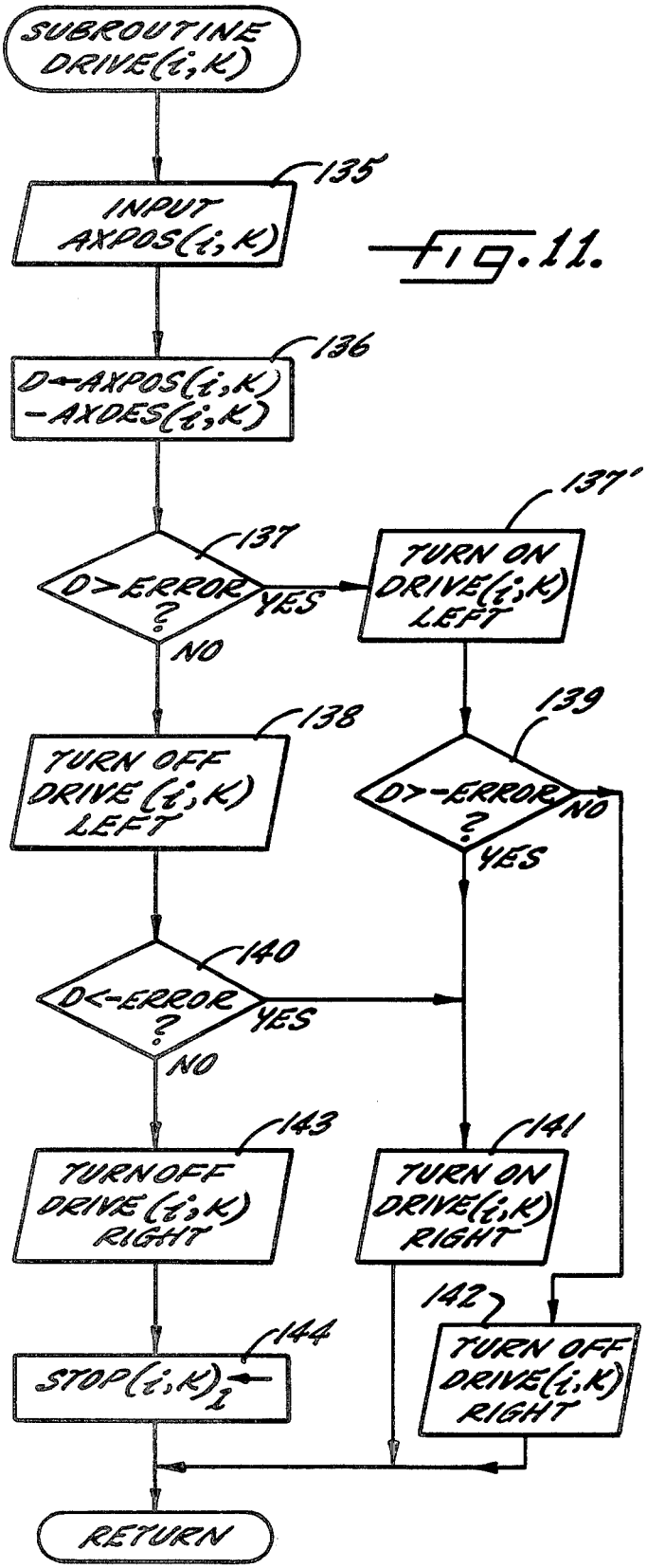
FIG. 11 is a subroutine which turns on and off the linear drive to the scanners for driving the scanners to predetermined coordinates.

The POSITION subroutine for moving the scanners 11, 12 to any desired coordinates is shown in FIG. 10. In step 130 an array STOP of flags is cleared. Then in step 131 the subroutine DRIVE of FIG. 11 is called for each left or right scanner 11, 12 associated with each of the N plate cylinders. The respective element in the STOP array is set to one when the corresponding scanner reaches its desired axial coordinate. Thus, in step 132, execution loops back to step 131 unless all of the elements of the array STOP have been set to one. If they all have been set to one, execution of the POSITION subroutine is finished.

The DRIVE subroutine is shown in FIG. 11. The DRIVE subroutine decides whether to turn on or turn off the drive motor for an individual designated one of the scanners 11, 12. Basically, the designated drive motor is turned off and the corresponding element of the STOP array set to one if the actual position of the designated scanner is very close to its desired position. The motor is turned on in either the right or left direction depending on whether the desired axial coordinate is greater or less than the actual axial position, respectively. Thus in step 135 the actual axial position of the indicated scanner 11, 12 is obtained by reading out the scanner position from the dual latch 47 in FIG. 4. In step 136 the actual position AXPOS is compared to the desired position AXDES by subtraction to calculate a difference D. If the difference D is greater than a predetermined small error as detected in step 137, the indicated drive is turned on to move left, thereby tending to reduce the magnitude of the difference D. Otherwise, in step 131 the indicated left drive output (see FIG. 8) is turned off. Then in either step 139 or step 140, the difference D is compared to the additive inverse of the predetermined error, and if the difference is more negative, the indicated right drive is turned on in step 141. If the difference is more positive in step 139, then the indicated right drive output is turned off in step 142. But if the difference is more positive in step 140, the indicated right drive output is turned off in step 143, and the indicated element of the STOP array is also set to one in step 144. Note that if step 144 is reached the magnitude of the difference D is less than the magnitude of the predetermined error. Hence, when step 144 is reached, the indicated scanner has been moved to its desired location.

The interrupt routine shown in FIG. 12 is executed after a rising or falling transition on the INTERRUPT input shown in FIG. 4. In step 145 the polarity determining bit in the interrupt register of the computer is tested to determine whether the interrupt was caused by either a positive or negative transition. If the transition was positive, corresponding to the beginning of the gating "window," the interrupt polarity determining bit is set negative in step 146. In other words, the polarity determining bit is toggled in order to avoid the need for both a positive polarity interrupt input line and a negative polarity input line to the computer. In step 147 the RUN flag is tested and if it is off the interrupt routine is completed. But if the run flag is set to one, then in step 148 the linear drives are turned on left in order for the optical sensors 31 of the scanners 11, 12 to sweep out the diagonal paths 29, 30 shown in FIG. 3. Thus the linear drives continue to move the scanners 11, 12 to the left until another interrupt occurs on the falling edge of the GATING SIGNAL. At this time the initial step 145 determines that the interrupt polarity is negative so that execution branches to the right-hand side of the flow chart in FIG. 12. In step 149 the interrupt is disabled and the interrupt polarity is set positive in anticipation of the next cycle of rotation of the plate cylinder 19. Also, the interrupt flag INTFG is set to one since at the end of the current pass through the interrupt routine of FIG. 12 the executive program must process the data obtained at the end of the gating "window." In step 150 the run flag is tested and if it is not set to one the interrupt routine is finished. Otherwise, in step 151 the scanners are returned to their initial positions by repeating the positioning operations originally performed in step 113 of the executive program. Finally, in step 151, the data latched in the scanner interface of FIG. 4 (for example in the latches 41, 47 and the counter 43) are transferred to storage locations in the computer's memory. Thus, when execution returns to the executive program, the computer will find that the interrupt flag INTFG has been set to one and thus it may assume that the data from the scanner interface has been transferred to the respective memory locations.

Figure 13:
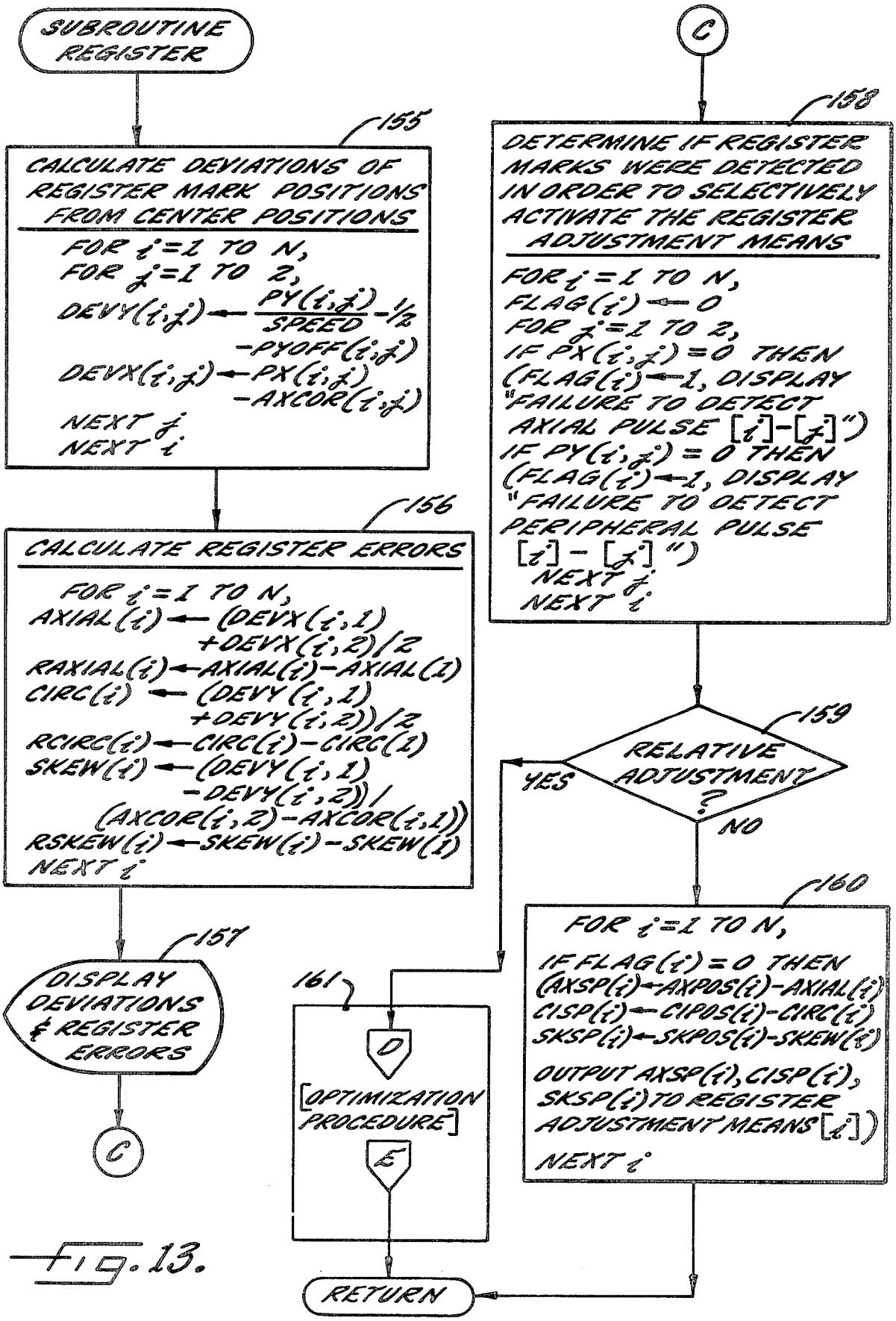
FIG. 13 is a flow chart of the subroutine which determines the register errors from the sensed positions of the register marks.

The subroutine REGISTER, which actually calculates the register errors and activates the register adjusting devices, is shown in FIG. 13. In step 155 the deviations of the register mark positions from the desired center positions is calculated and stored in arrays DEVY and DEVX. In step 156 the register errors are calculated from the deviations. The axial error, for example, is the average of the right and left axial deviations of the register marks, while the peripheral deviation is also the average of the peripheral deviations for the right and left register marks. (It should be noted that the axial register could be determined from the axial deviation of only one register mark per cylinder, so that one of the optical sensors shown in FIG. 4 is not essential). The diagonal or skew deviation, on the other hand, is equal to the difference in the peripheral deviations for the right and left hand register marks, divided by the axial distance of separation of the right and left register marks. Relative deviations are also calculated in step 156 using the deviation for the first printing plate cylinder as a reference. It should be noted that for the peripheral register errors, the relative deviations should give a better indication of register adjustment since any noise on the least significant bit of the resolver 24 is effectively subtracted out by the relative error difference calculations.

In step 156 the deviations and register errors for the individual plate cylinders are displayed to the printing machine operator. But before the register adjustment means are activated, the computer in step 158 checks to determine whether register marks were actually detected in order to selectively activate only the register adjustment means for cylinders having properly detected register marks. It should be noted that the circuitry of FIG. 4 automatically resets the counter 43 and the latches 41 coincident with the leading edge of the GATING SIGNAL. Therefore, if a register mark is not detected, the value in the corresponding latch will still be equal to zero at the end of the gating "window." Thus, in step 158 a flag array FLAG is set to zero and the individual positions PX corresponding to the latches 41 in FIG. 4 are compared to zero. If any of the positions PX or PY for a plate cylinder is equal to zero, then the FLAG array element corresponding to that cylinder is set to one and a message communicating the error condition to the operator is displayed on the display 23. The array FLAG is later used in the register adjustment procedure to inhibit the activation of the individual register adjustment means 16, 17 and 18 for the indicated plate cylinder 19.

In step 159 the computer determines whether the machine operator desires a relative adjustment or an absolute adjustment with respect to the reference positions supplied by the operator in the very initial step 110 of FIG. 9. If an absolute adjustment is requested, then in step 160 if the corresponding FLAG array element is zero, the set points for the register adjusting devices 16, 17, and 18 are calculated as the actual current plate cylinder positions for the register adjustments (available as inputs to the computer from the register adjusting devices) less the register errors. The set points are then transmitted to the register adjustment devices to complete the execution of the subroutine REGISTER. But if a relative register adjustment is requested, then an optimization procedure in steps 161–164 is executed.

Figure 14:
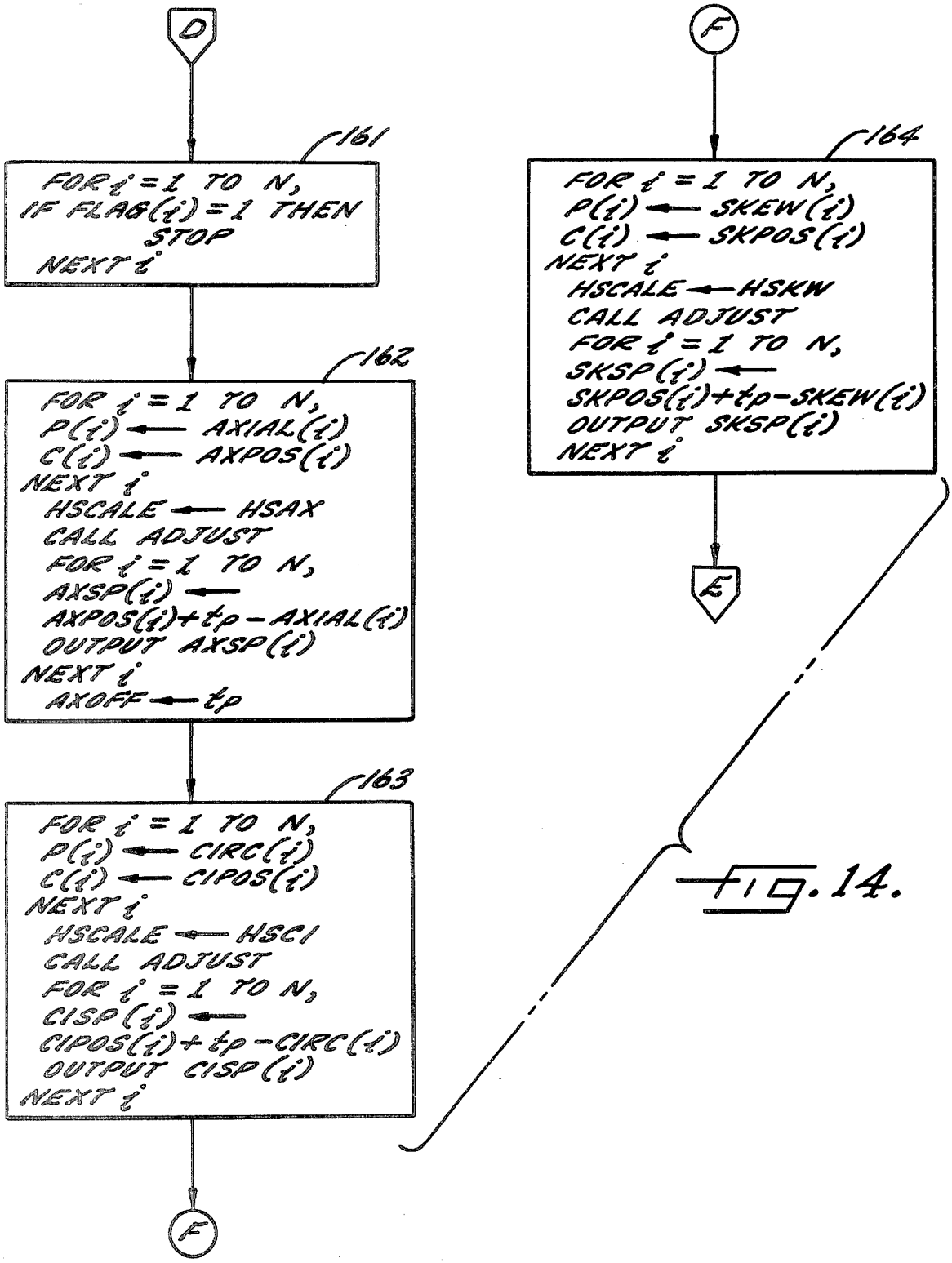
FIG. 14 is a flow chart of a procedure for controlling the register adjustment means to perform a relative register adjustment.

The optimization procedure in steps 161–164 is shown in detail in FIG. 14. Since a relative adjustment is desired, the axial and peripheral deviations for all of the cylinders are needed. In step 161 execution is suspended if any element of the FLAG array is a 1, indicating a failure to receive a pulse detecting a register mark. In steps 162–164, the axial, peripheral and diagonal errors and positions are sequentially loaded into subroutine parameter arrays P and C, respectively, and the respective half scale value for the axial, peripheral or diagonal register adjusting device is loaded into the half scale parameter HSCALE. Then an adjusting subroutine ADJUST is called in steps 162, 163 and 164 to determine the optimum target positions for the printing plate axial, peripheral and diagonal register, respectively. The subroutine ADJUST returns a printing plate position set point or target position corresponding to a respective one of the register adjustments which will lead to register mark coordinates generally different than the reference coordinates entered by the machine operator in the very initial step 110 of FIG. 9. This printing plate set point or target position is then used to calculate the respective axial, peripheral or diagonal set points for plate cylinder position which are transmitted to the respective register adjusting device 17, 16, and 18.

The subroutine ADJUST determines the optimum printing plate target position in order to minimize the register adjustment time and also to insure that the maximum range of available plate positions is fully utilized. These concepts are best understood by reference to an example worked out in Table I appended at the end of the specification. In the first column are listed the plate cylinder numbers or value of the index i. In the general case the plate cylinder adjustment device will not have preset the plate cylinder positions to the middle of the adjustment range. Thus, in the second column the positions or deviations of the plate cylinders from the midpoint of the adjustment range is listed and denoted as C. In the third column are listed the initial printing plate positions P with respect to the machine frame which are indicated by sensing the register marks. If the plate cylinders are moved to the center of the adjustment range, the printing plate positions will have values P−C as shown in the fourth column of Table I. Since the plate cylinder positions are adjustable within a limited range, that range assumed to be normalized to a value of 1.0, the range of available plate positions is calculated as (P−C)+0.5 as shown in the last right-hand column.

From the tabulated parameters in Table I, the range of registering printing plate positions may be determined as the intersection of the individual ranges of available plate positions for all of the plate cylinders. If the intersection is the null set, then the printing plates cannot be automatically registered. In such a case the machine operator must be told that register cannot be achieved and that the printing plates for the printing machine must be unclamped and repositioned. For the example in Table I, it is evident that the minimum point of the range of registering positions is the maximum of the minima points of the ranges of available plate positions. Similarly, the maximum point of the range of registering positions is the minimum of the maxima of the ranges of available plate positions.

If the range of registering positions was unlimited, then the adjustment time required for registering the printing plates could be minimized by selecting a set or target point at the midpoint between the maximum printing plate position and the minimum printing plate position Hence, in step 1 of the procedure worked out for the data and Table I, the maximum value of the printing plate positions P is determined as 0.6. In step 2 the minimum value of the printing plate positions is found to be −0.3. A first guess at the best target point tp is calculated as the average of the maximum and minimum printing plate positions, or 0.15. But this initial guess for the target point tp cannot be used if it is outside the range of registering positions. In such a case, the target point should be set to the closest end point of the range of registering positions. Thus, in step 4 the minimum value of the printing plate positions if the plate cylinder is moved to the center of its adjustment range, or P−C, is found to be −0.1. Similarly the maximum of P−C is determined as 0.7. The minimum of the range of registering plate positions MIN is calculated as the maximum of P−C, less half of the adjustment range, resulting in a minimum MIN of 0.2. Similarly, in step 7 the maximum of the range of registering plate positions MAX is calculated as the minimum of P−C, plus one-half of the adjustment range, resulting in a value MAX of 0.4. Actually these calculations for MIN and MAX will give results even if the range of registering positions is the null set. This condition, indicating that register cannot be achieved, can be tested for by comparing the calculated minimum MIN to the calculated maximum MAX. If the minimum MIN is less than or equal to the maximum MAX then register can be achieved. Moreover, the initial value of the target point tp of 0.15 may be used so long as the target point tp is within the calculated range of registering positions. To determine whether the target point is inside the range of registering positions, the target point tp must be less than or equal to MAX and also greater than or equal to MIN. For the example, in step 9, these comparisons are performed and it is found that the target point is not inside the range of registering positions. In step 10, the closer of MIN or MAX to the initial target point tp is selected as the target point. Thus, if the initial value of the target point tp is less than or equal to MIN, then the target point tp is set equal to the minimum MIN. This in fact is found to be the case for the values in Table I. Otherwise, the initial value of the target point tp would have been greater or equal to the maximum MAX, and the target point tp would have been set equal to the maximum value MAX.

Figure 15:
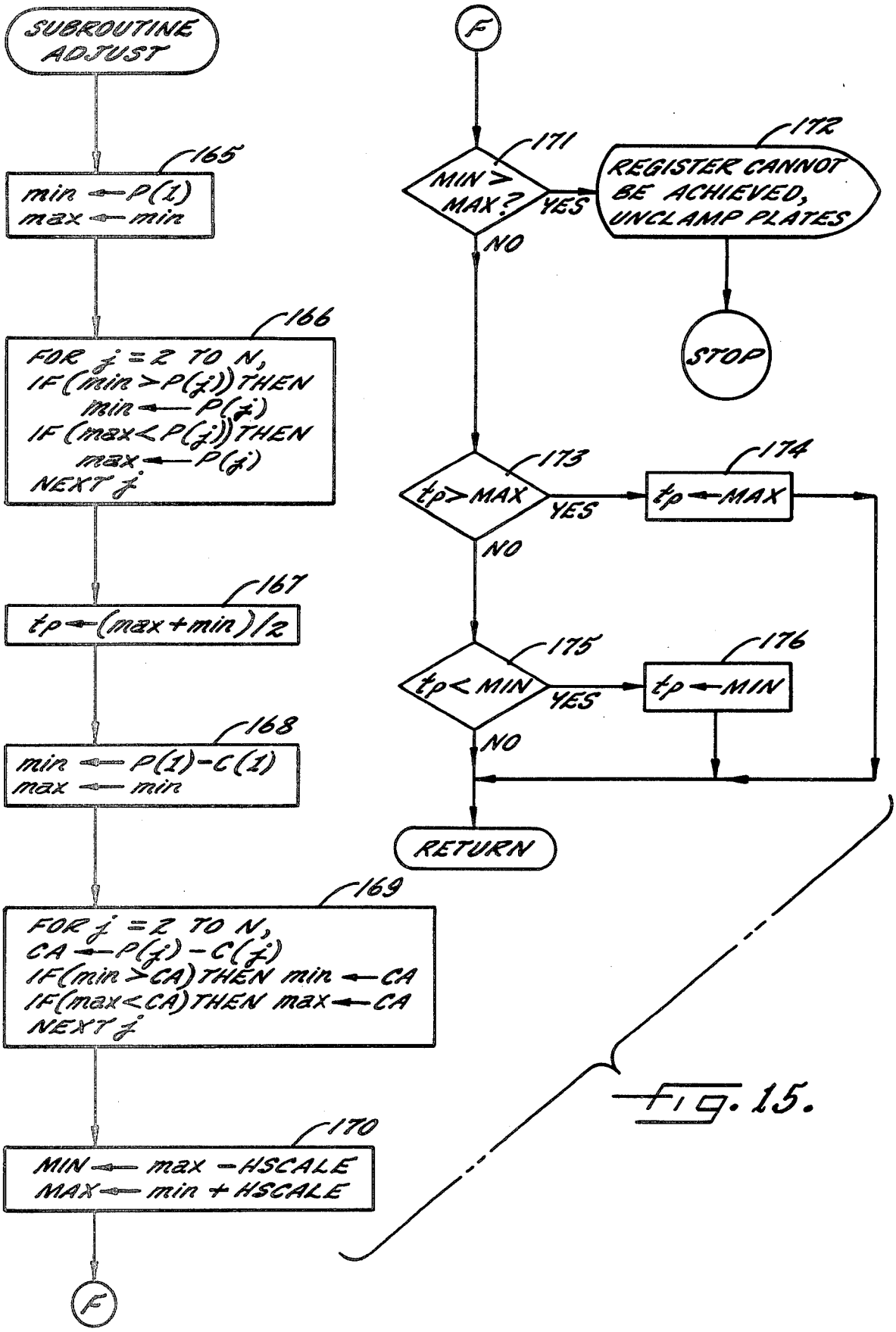
FIG. 15 is a flow chart of a subroutine for optimizing the travel of the register adjustment system in response to combined substantially identical deviations of the register marks, as further illustrated by the example in Table I appended to the specification.

The exemplary procedure worked for the data in Table I may be performed by the computer 13 by executing the subroutine ADJUST in FIG. 15. In the first step 165, in preparation for finding the maximum and minimum values of the array of printing plate positions P, a minimum min and maximum max are set equal to the first element of the array P(1). In step 166 these initial values of min and max are tested against the remaining array values P(i) and if smaller or larger array elements than the first element minimum min or maximum max are found, then they are used as the minimum and maximum, respectively. Once the minimum and maximum of the printing plate positions is found, an initial value of the target point tp is calculated in step 167 as the average of the minimum and maximum. To determine the range of registering positions, the maxima and minima of P−C is determined in a similar fashion by initially setting a minimum min and maximum max to the difference between the first elements P(1) and C(1), as calculated in step 168. Then in step 169 these values min and max are compared to the differences CA between the other array elements and set to the lower or higher values. Thus, in step 170 the minimum MIN and maximum MAX of the range of registering positions are calculated as max−HSCALE and min+HSCALE, respectively, where HSCALE denotes half of the full scale adjustment range. To determine whether there is in fact a range of registering positions, the minimum MIN is compared to the maximum MAX, in step 171. If the minimum MIN is greater than the maximum MAX then in step 172 the machine operator is instructed that register cannot be achieved and the printing plates must be unclamped. If the minimum MIN is not greater than the maximum MAX, then there is a range of registering positions. To determine whether the initial value of the target point tp is within the range of registering positions, in step 173 the target point tp is compared to the maximum MAX. If the value of the target point tp is greater than the maximum MAX, in step 174 the target point tp is set equal to the maximum MAX. Otherwise in step 175 the target point tp is compared to the minimum MIN. Similarly if the target point tp is less than the minimum MIN, then in step 176 the target point tp is set equal to the minimum MIN. Otherwise, the target point tp is within the range of registering positions, and need not be altered from its initial value calculated in step 167.

The target point tp is returned to step 162, 163, or 164, FIG. 14, and the adjustment set point for plate cylinder position is in effect offset by the target position so that the register errors for all of the printing plates will become equal to the target point after several iterations. The target point tp for the axial case may, in step 162 (FIG. 14), also be saved as an axial offset AXOFF for slightly shifting the scanners 11, 12 toward the new target point. For such a modification to the exemplary computer program, AXOFF should be set to zero in step 115 (FIG. 9) before the interrupt is enabled, and the desired axial positions AXDES(i,j) should be increased by AXOFF in step 151 (FIG. 12) before the POSITION subroutine is called.

In view of the foregoing, an automatic register adjustment system has been disclosed which, before printing starts, enables the printing plates to be adjusted relatively to one another for precise register. The register marks may be placed at any desired position on the printing plates, and the reference coordinates of the register marks may be freely programmed. The system, then, is suitable for use on perfector stop-cylinder machines. The scanners can approach any desired point on the printing plate, so that the register marks can be disposed on the printing plates at the optimum locations consistent with the layout of the printed matter.

TABLE I

EXEMPLARY REGISTER ADJUSTMENT VALVES AND PROCEDURE

| i Plate Cylinder | C Initial Plate Cylinder | P Printing Plate Positions | P-C Printing Plate Positions If Cylinder Is Moved To The Center Of The Adjustment Range | (P-C) ± 0.5 Range of Available Plate |
|---|---|---|---|---|
| 1 | 0.1 | 0.2 | 0.1 | −0.4, 0.6 |
| 2 | −0.2 | −0.3 | −0.1 | −0.6, 0.4 |
| 3 | 0.5 | 0.6 | 0.1 | −0.4, 0.6 |
| 4 | −0.4 | 0.3 | 0.7 | 0.2, 1.2 |
| | | | Range of Registering Positions = | (0.2, 0.4) |

1. max P = 0.6
2. min P = −0.3
3. target point = (Max P + Min P)/2
   tp = 0.15
4. min (P-C) = −0.1
5. max (P-C) = 0.7
6. minimum of registering = max (P-C) − 0.5
   plate positions
   MIN = 0.2
7. maximum of registering = min (P-C) + 0.5
   plate positions
   MAX = 0.4
8. Can register be achieved?
   MIN ≦ MAX? YES
9. target point inside?
   tp ≦ MAX and tp ≧MIN? NO
10. pick closer MIN or MAX to tp
    tp ≦ MIN YES tp = MIN
    tp ≧ MAX NO

I claim as my Invention:

1. An automatic control system for adjusting at least the axial and peripheral register in a printing machine in response to the axial and peripheral position of at least one register mark on at least one printing plate mounted on a plate cylinder, the control system comprising, in combination, register adjustment devices for axial and peripheral register operable by computer control, a computer for performing numerical calculations and operating the register adjustment devices, scanning means for sensing the axial and peripheral positions of the register mark on the printing plate, the scanning means being mounted for traversing, generally axial movement with respect to the machine frame, computer operable means for driving the scanning means to a desired axial coordinate, the computer being programmed to provide means for receiving and storing, in memory, predetermined reference coordinates of the register mark, driving the scanning means to approximately the predetermined axial coordinate of the register mark, obtaining axial and peripheral coordinates of the register mark from the output of the scanning means, comparing the axial and peripheral coordinates of the register mark to predetermined reference coordinates stored in the computer's memory to determine axial and peripheral register errors, and controlling the register adjustment devices so that in response to the determined register errors, the axial and peripheral register errors are reduced.

2. The control system as claimed in claim 1, wherein the register marks are in the form of crosses, at least one limb of the register mark for indicating axial register extending over a zone of the plate cylinder periphery.

3. The control system as claimed in claim 1, further comprising means for setting the speed of traverse travel of scanning means at a speed generally proportional to the rotational speed of the plate cylinder.

4. The control system as claimed in claim 1, further comprising means for indicating to the operator whether at least one of the register errors exceeds the maximum adjustment travel of the respective register adjusting device, thereby signalling that the printing plate should be dismounted and manually adjusted.

5. The control system as claimed in claim 1, wherein the computer is inhibited from controlling at least one of the register adjustment devices when at least one of the register errors exceeds the maximum adjustment travel of the respective register adjusting device.

6. The control system as claimed in claim 1, further comprising means for separately displaying the axial and peripheral register errors to the machine operator.

7. An automatic control system for reducing the setting-up times in the printing process by adjusting the axial, peripheral, and diagonal register in a multi-color printing machine before printing occurs, the printing machine having a plurality of plate cylinders with associated printing plates mounted thereon, the printing plates having register marks incorporated thereon, the printing machine having remotely-controllable devices for adjusting peripheral, axial and diagonal register associated with each of the plate cylinders, the control system comprising, in combination, a computer for performing numerical calculations and operating the register adjustment devices, an angular resolver for indicating to the computer the phase of the machine drive, optical scanning means associated with each plate cylinder for sensing the relative axial and peripheral positions of respective register marks on the associated printing plates with respect to the positions of the scanning means, the scanning means being mounted for traversing, generally axial movement with respect to the associated plate cylinder, computer controllable means for driving the scanning means for each plate cylinder to desired predetermined axial locations with respect to the machine frame, means for generating a gating signal to enable the optical scanning means to sense the register marks only during a predetermined range of plate cylinder phase, the predetermined range being specified by the computer, detector means for processing the output of the optical scanning means when enabled by the gating signal and generating a signal for input to the computer responsive to the times when the respective scanning means are precisely aligned with their respective register marks, thereby indicating the axial and peripheral coordinates of the register marks, the computer being programmed to provide means for commanding the means for driving to move the scanning means to at least one predetermined axial coordinate and for outputting to the means for gating at least one predetermined peripheral coordinate, the coordinates specifying the general locations of the register marks on the printing plates, thereafter, in response to the phase angle from the angular resolver, commanding the means for driving the scanners to traversably reciprocate the scanners in synchronism with the rotation of the plate cylinder so that the scanning means traverse across the respective register marks, obtaining axial and peripheral coordinates of the register marks from the signal received from the detector means, comparing the axial and peripheral coordinates of the register marks and computing axial, peripheral, and diagonal register errors in response to the comparisons, and controlling the register adjustment devices in response to the computed register errors so that the register errors are reduced.

8. The control system as claimed in claim 7, wherein the computer is further programmed to provide means for minimizing the adjustment travel and adjustment time of the remotely-controllable register adjustment devices by determining, for axial, peripheral and diagonal register, a printing plate position set point which is midrange of the respective printing plate positions indicated by the axial and peripheral coordinates of the register marks.

9. The control system as claimed in claim 8, wherein the computer is further programmed to provide means for determining, for axial, peripheral and diagonal register, whether there exists a range of registering positions, and if there is a range of registering positions, comparing the respective midrange printing plate position set point to the range of registering positions, and if the midrange set point is outside of the range of registering positions, setting the set point approximately to the closer end point of the range of registering positions.

10. The control system as claimed in claim 7, wherein the computer is programmed to provide means for determining, for axial, peripheral and diagonal register, whether there exists a range of registering positions, and if there is not a range of registering positions, indicating to the machine operator that the register error exceeds the maximum adjustment travel.

11. The control system as claimed in claim 7, wherein the register marks are in the form of crosses, having one extended axial limb and one extended peripheral limb.

12. The control system as claimed in claim 7, wherein the speed of travel of the scanning sytems as they are traversely reciprocated is generally proportional to the rotational speed of the printing machine when side register measurement is performed.

13. The control system as claimed in claim 12, further comprising means for obtaining a numeric measurement of the rotational speed of the printing machine responsive to the output of the angular resolver, the numeric measurement being inputted to the computer, the computer being programmed for computing from the numeric measurement a control value commanding the speed of travel of the scanning system, and the scanning system having means for responding to the control value commanding its speed of travel.

14. The control system as claimed in claim 7, further comprising means for separately displaying axial, peripheral and diagonal register errors to the machine operator.

15. An automatic control method performed by a computer for adjusting the axial, peripheral, and diagonal register in a multi-color printing machine before printing occurs, the printing machine having a plurality of plate cylinders and associated printing plates mounted thereon, each of the printing plates having register marks incorporated thereon, the printing machine having computer controllable devices for adjusting peripheral, axial and diagonal register associated with the plate cylinders and having scanning means for sensing the axial and peripheral positions of the register marks on the printing plates, the scanners being mounted to the machine frame for computer controllable generally axial movement with respect to the respective plate cylinders to axial coordinates with respect to the machine frame specified by the computer, the printing machine having gating means associated with the scanning means for enabling the sensing of the register marks when the marks have peripheral coordinates within a predetermined range of peripheral coordinates about at least one peripheral coordinate specified by the computer, the control method comprising the steps of:

receiving from the machine operator axial and peripheral reference coordinates specifying the approximate locations of the register marks incorporated on the printing plates, commanding the scanning means to axially move to approximately the axial reference coordinates, specifying at least one of the peripheral reference coordinates to the gating means associated with the scanning means so that the scanning means are enabled to sense the axial and peripheral positions of the register marks, obtaining the axial and peripheral coordinates of the register marks from the output signal of the scanning means, computing axial, peripheral and diagonal register errors from the axial and peripheral coordinates of the register marks, and adjusting the axial, peripheral and diagonal register adjusting devices in response to the respective register error.

16. The control method as claimed in claim 15, further comprising the step of axially reciprocating the scanning means in order to sense the axial coordinates of the register marks.

17. The control method as claimed in claim 16, further comprising the step of setting the axial speed of the scanning means generally proportional to the rotational speed of the plate cylinders.

18. The control method as claimed in claim 15, further comprising the step of separately displaying the axial, peripheral and diagonal register errors to the machine operator.

19. The control method as claimed in claim 15, further comprising the steps of calculating, for axial, peripheral and diagonal register, whether there exists a range of registering positions, and if there is not a range of registering positions, indicating to the machine operator that the register error exceeds the maximum adjustment travel.

20. The control method as claimed in claim 15, further comprising the steps of determining, for axial, peripheral and diagonal register, a printing plate position set point which is midrange of the printing plate positions indicated by the coordinates of the register marks.

* * * * *